United States Patent [19]

Lapart

[11] 4,368,004

[45] Jan. 11, 1983

[54] APPARATUS FOR PREVENTING A TURBINE FROM EXCEEDING A PREDETERMINED VALUE OF A MONITORED PHYSICAL MAGNITUDE

[75] Inventor: André Lapart, Le Blanc Mesnil, France

[73] Assignee: Societe Anonyme dite: Alsthom-Atlantique, Paris, France

[21] Appl. No.: 200,624

[22] Filed: Oct. 27, 1980

[30] Foreign Application Priority Data

Oct. 25, 1979 [FR] France ..... 79 26488

[51] Int. Cl.[3] ..... F01B 17/06

[52] U.S. Cl. ..... 415/39; 415/36; 137/53

[58] Field of Search ..... 415/36, 39; 137/53; 60/39.09 R; 416/45

[56] References Cited

U.S. PATENT DOCUMENTS

| | | | |
|---|---|---|---|
| 2,675,987 | 4/1954 | Gleason et al. | 137/49 X |
| 2,756,810 | 7/1956 | Simmons | 137/51 X |
| 2,946,189 | 7/1960 | Basford | 60/39.09 R X |
| 3,139,166 | 6/1964 | Berlyn | 60/39.09 R X |

FOREIGN PATENT DOCUMENTS

| | | |
|---|---|---|
| 560948 | 9/1932 | Fed. Rep. of Germany . |
| 947342 | 2/1956 | Fed. Rep. of Germany . |
| 1486102 | 5/1967 | France . |
| 1572669 | 5/1969 | France . |

*Primary Examiner*—Philip R. Coe
*Assistant Examiner*—Frankie L. Stinson
*Attorney, Agent, or Firm*—Sughrue, Mion, Zinn, Macpeak & Seas

[57] ABSTRACT

An apparatus for preventing a turbine from exceeding a predetermined value of a monitored physical magnitude, the apparatus including an over-center toggle lever (3) pivotally mounted on a pivot point (6) on a stationary frame (7), the lever being capable of occupying a tripped position or a released position. In the cocked position, one arm (4) of the lever (3) presses against a stop (8) provided with a unit (20) which controls steam admission units to the turbine, the lever (3) moves away from the stop, steam is cut off, while the end (14) of the other arm (5) is pivotally mounted on the end of a connecting rod (10) which is pivotally mounted at its other end on a pin (11) which is integral with a piston (12) which a spring (16) pushes away. A mass (2) strikes the lever (3) which moves to the tripped position if the monitored magnitude exceeds the predetermined value. Due to the fact that the frame (7) and apparatus assembly is resilient, the lever can be tripped even if the piston (12) seizes in the associated cylinder (15). The apparatus of the invention is a high-security apparatus.

9 Claims, 2 Drawing Figures

APPARATUS FOR PREVENTING A TURBINE FROM EXCEEDING A PREDETERMINED VALUE OF A MONITORED PHYSICAL MAGNITUDE

The present invention relates to an apparatus for preventing a turbine from exceeding a predetermined value of a monitored physical magnitude, said apparatus including an over-center toggle lever pivotally mounted on a pivot point on a stationary frame. The lever is capable of occupying either one of two stable positions, one of which is a cocked position in which it abuts against a stop, said cocked position corresponding to normal operation of the turbine. The other position is a tripped position which corresponds to abnormal operation of the turbine, said toggle lever being tripped to the tripped position when a monitor detects a predetermined value of said physical magnitude being exceeded. The tripped position of the lever causes turbine admission units to close. The apparatus also includes a connecting rod with one end pivotally mounted to an end of the toggle lever which is remote from the pivot point of the toggle lever on the frame. The other end of the connecting rod is pivotally mounted on a piston that is guided in a cylinder and is permanently subjected by a spring to a compression force directed towards the connecting rod and the toggle lever. The toggle lever, when in the cocked position, forms an angle of about 180° with the connecting rod.

BACKGROUND OF THE INVENTION

Such an apparatus is described in U.S. Pat. No. 2,675,987.

In the known apparatus, the piston must travel some distance before a hydraulic control circuit can be drained thereby causing steam admission to close.

The danger in such an apparatus is that the piston will seize, in which case even though the toggle lever is pushed back towards its tripped position, the toggle lever does not move far enough for the hydraulic circuit to drain, and steam admission is therefore not closed.

SUMMARY OF THE INVENTION

The apparatus according to the invention reduces such dangerous consequences of the piston seizing by ensuring that the frame and apparatus assembly is resilient so that in the event of the piston seizing in the cylinder, the toggle lever can still be moved to the tripped position by ensuring that the apparatus includes means for closing the fluid admission units to the turbine which means are actuated by the toggle lever itself when it moves from the cocked position to the tripped position even when the piston is seized.

Thus, in the apparatus in accordance with the invention, even if the piston does seize, the lever can still trip, and since the closure control means are controlled by the lever itself and not by the piston, the steam inlet is thereby effectively closed.

According to a preferred embodiment of the invention, the closing control means includes a hydraulic circuit which has a vent, said vent opening out in a stop for the toggle lever and being closed by the toggle lever when in the cocked position.

Thus, as soon as the toggle lever moves away from the stop, the pressure of the hydraulic circuit drops, causing the inlet to close. As a variant, control means can be used which include a proximity detector located on said stop.

In accordance with a preferred embodiment of the invention, the piston is used to cock the lever.

For this purpose, the apparatus according to the invention includes, in an advantageous embodiment, a return spring for returning the toggle lever to the cocked position with said spring exerting a smaller force on the toggle lever in the tripped position than that applied by the piston which thereby tends to hold the lever in the tripped position. The piston is provided with a cocking control circuit for causing the piston to slide rearwards for a short instant, thereby compressing the associated spring and allowing the toggle lever to be cocked by the return spring.

Thus, when the piston is urged to the bottom of its cylinder away from the toggle lever, the toggle lever return spring is free to push said toggle lever back to the cocked position. However, the force of the return spring in the tripped position is less than required in normal circumstances to overcome the force applied by the piston, thereby ensuring stability in both the cocked and the tripped positions.

In apparatus in accordance with the invention, even if a cocking instruction is applied permanently, whenever the monitored magnitude exceeds the fixed value, the toggle lever is pushed back to the tripped position each time it is cocked.

In the cocked position one end of the toggle lever rests against said stop, thereby controlling the admission of steam to the turbine.

In accordance with an improvement of the invention, the upper surface of the piston communicates with the same hydraulic circuit as the one which opens out in the said stop. Thus, the force developed by the fluid pressure on the upper surface of the piston tends to counterbalance the force with which the fluid attempts to lift the toggle lever off its stop. This prevents the lever from tripping under the effect of hydraulic pressure applied at the stop. It must also be observed that when the lever is in the tripped position, the hydraulic circuit is connected to the drainage system and the pressure developed on the upper surface of the piston is zero whereby there is no hydraulic pressure to oppose the movement of the piston during cocking.

Preferably, the apparatus in accordance with the invention is fitted with an auxiliary stop which absorbs the shock of the toggle lever snapping into to the released, tripped position. This avoids the danger of rebounds.

BRIEF DESCRIPTION OF THE DRAWINGS

The present invention will be better understood from the description given hereinafter with reference to the accompanying drawings.

DETAILED DESCRIPTION OF PREFERRED EMBODIMENTS

Figure 1:
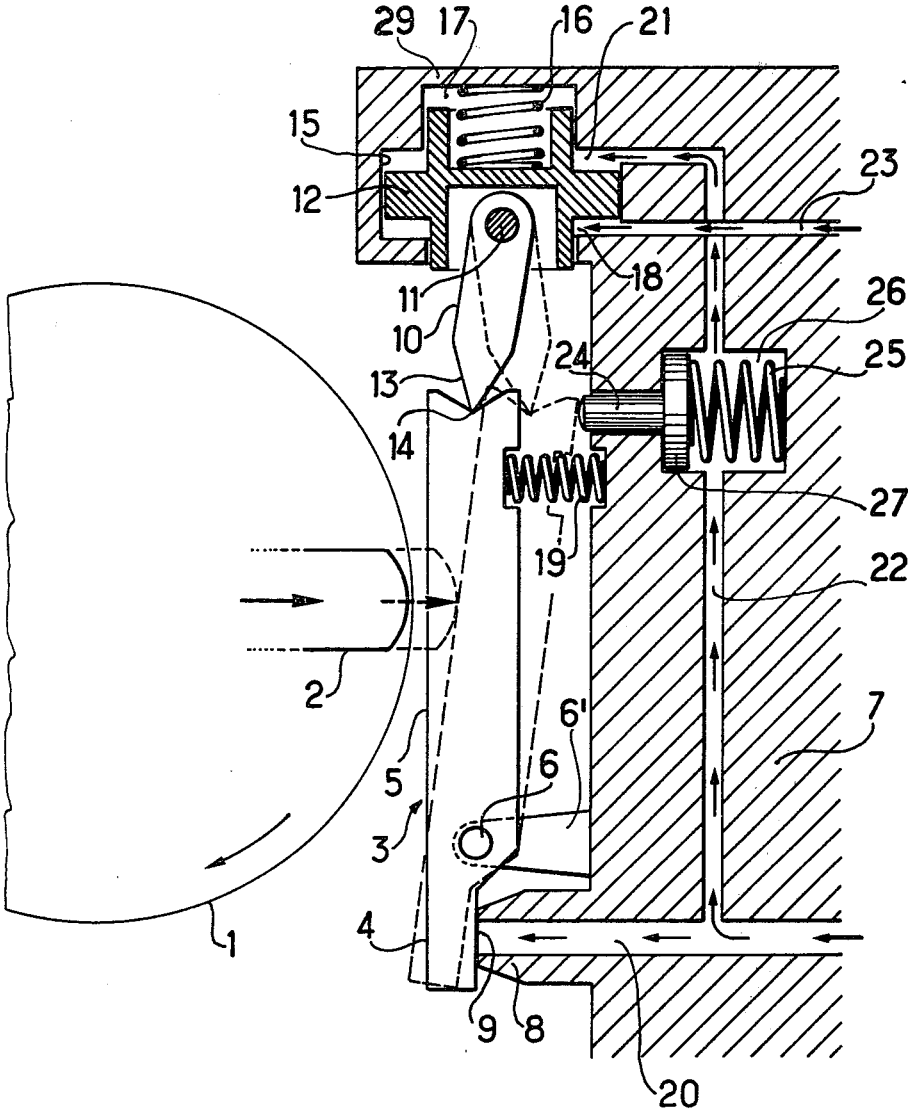
FIG. 1 is a sectional view which illustrates a preferred embodiment of the apparatus in accordance with the invention.

FIG. 1 schematically illustrates a turbine rotor 1 with a mass 2 resiliently fixed thereto. The mass 2 is eccentrically located with respect to the rotor axis. In the event of the rotor overspeeding, the mass 2 strikes a toggle lever 3 which moves from a cocked position shown in solid lines to a tripped position shown in broken lines.

The toggle lever 3 comprises a first arm 4 and a second arm 5 pivoted at 6 on a post 6′ projecting from a stationary frame 7.

In the cocked position shown in solid lines, the first arm 4 bears against a stop 8 and closes vent 9 of a hydraulic safety circuit partially illustrated by a duct 20. When the hydraulic safety circuit is drained, the turbine admission units are closed.

A connecting rod 10 is pivotally mounted at one of its ends to a piston 12 and its other end 13, which is knife-shaped, bears in a V-shaped notch the end 14 of the second arm 5 of the toggle lever 3. The piston 12 moves in a cylinder 15 and is subjected to an axial thrust exerted by spring 16 located in a cavity 17.

This mechanical apparatus thus has three pivot points 6, 14 and 11 subject to a compression force by the spring 16, thereby stabilizing the system very well both in its cocked position and in its tripped position (in broken lines). In the cocked position the angle between the connecting rod 10 and the lever 3 is almost 180°.

When the toggle lever 3 is in the cocked position, the mass 2 trips it by striking it, and when said toggle lever is in the tripped position, it can be returned to the cocked position only by applying pressure to the lower chamber 18 of the cylinder 15 thereby pushing piston 12 upwards until the three pivot points 6, 14 and 11 are aligned; a return spring 19 then moves these three aligned pivot points out of line in the required direction, i.e. towards the cocked position such as shown in continuous lines. The required cocking pressure is applied by means of a hydraulic cocking circuit which communicates with the chamber 18 via a duct 23. It is quite evident that the springs 16 and 19 are chosen such that in the cocked position, the effect of the spring 16 clearly overcomes that of the spring 19 which may be fairly weak since it is used only to move the three points 6, 14 and 11 out of line just before the pressure in cocking circuit 23 is reduced and the piston 12 is thereby lowered.

The frame 7 is somewhat resilient due to the thinness of that part 29 of the frame 7 which surrounds the cylinder 15 and the cavity 17. Other points of the apparatus, e.g. the rod 6′ or the pin 11 may also be resilient.

Thus, in the event that the piston 12 seizes in the cylinder 15, and since the points 11, 14 and 6 form an angle of almost 180°, the toggle lever can trip out of the cocked position when struck by the mass 2 because the frame and the apparatus are resilient.

The upper chamber 21 of the cylinder 15 communicates with the duct 20 via a duct 22.

Thus, when the lever is in the cocked position, the force developed by the pressure of the fluid on the toggle lever 3 level with the stop 8 counterbalances the force developed by the pressure of the fluid in the chamber 21.

When the lever is in the tripped position, the duct 22 which communicates with the duct 20 drains, and when pressure is applied in the lower chamber 18, there is no pressure in the upper chamber 21 to prevent cocking.

In the tripped position, the lever 3 presses against a moving stop 24 installed in the frame 7 with a spring 25 located in a cylinderical cavity 26 filled with fluid. The base 27 of the stop 24 which is also located in the cavity is in the form of a circular plate and said spring pushes it against one end of the cavity 26. The head of the stop 24 extends beyond the frame 7 and when the lever 3 strikes it, it depresses it and the spring and the dash-pot function of the circular base 27 in the cavity 26 absorb the shock.

Figure 2:
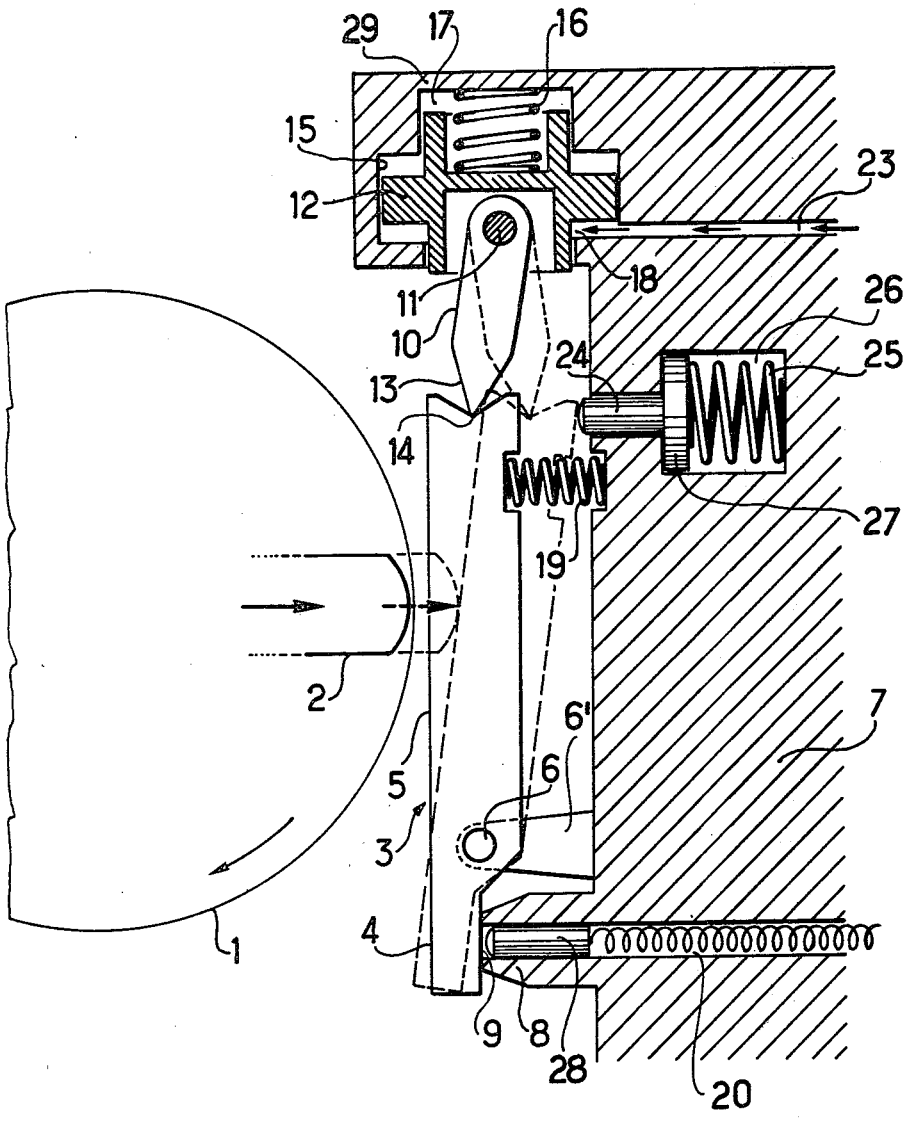
FIG. 2 is a similar sectional view to that of FIG. 1 which illustrates a variant thereof.

FIG. 2 illustrates a variant of the apparatus in accordance with the invention in which the position of the lever is detected by a proximity detector 28 disposed in the stop 8. When the toggle lever moves off the stop, the detector 28 closes the admission units of the turbine.

The toggle lever is set by injecting fluid under pressure into the lower chamber 18 of the cylinder 15 via the duct 23.

Magnitudes other than speed may be monitored, e.g. lubrication oil pressure.

I claim:

1. An apparatus for preventing a turbine from exceeding a predetermined value of a monitored physical magnitude, said apparatus including: a stationary frame, a stop, monitoring means, an over-center toggle lever pivotally mounted on a pivot point on said stationary frame, said lever being capable of occupying either one of two stable positions, one of which is a cocked position in which it abuts against said stop, said cocked position corresponding to normal operation of the turbine, the other position being a tripped position which corresponds to abnormal operation of the turbine, said toggle lever being tripped to the tripped position when said monitoring means detect that the predetermined value of said physical magnitude has been exceeded, said tripped position of the lever causing turbine admission units to close, said apparatus also including; a piston guided within a cylinder, a connecting rod having one end pivotally mounted to an end of the toggle lever which is remote from the pivot point of the toggle lever on the frame, and the other end of the connecting rod being pivotally mounted on said piston guided in said cylinder, a spring permanently subjecting said piston to a compression force directed towards the connecting rod and the toggle lever, the toggle lever when in the cocked position forming an angle of about 180° with the connecting rod, said frame and apparatus assembly being resilient so that in the event of the piston seizing in the cylinder, the toggle lever can still be moved to the tripped position and said apparatus includes closing control means actuated by the toggle lever itself when it moves from the cocked position to the tripped position, even when the piston is seized, for controlling the closing off of fluid admission units to said turbine.

2. Apparatus according to claim 1, wherein the closing control means includes a hydraulic circuit which has a vent, said vent opening out in a first stop for the toggle lever and being closed by the toggle lever when in the cocked position.

3. Apparatus according to claim 2, further including a return spring for returning the toggle lever to the cocked position, said spring exerting a smaller force on the toggle lever in the tripped position than that applied by the piston to thereby tend to hold the lever in the tripped position, and a cocking control circuit for said piston for causing the piston to slide within said cylinder for a short instant, thereby compressing the associated spring and allowing the toggle lever to be cocked by the return spring.

4. Apparatus according to claim 3, wherein the cocking control circuit is hydraulic and including means for injecting fluid in one chamber of the cylinder to effect cocking thereof.

5. Apparatus according to claim 4, wherein another chamber of the cylinder to the side opposite said one chamber communicates with the hydraulic circuit which opens out at a second stop for the toggle lever in the cocked position.

6. Apparatus according to claim 4 or 5, wherein said second stop is a moving stop which forms a dash-pot and absorbs the shock of the toggle lever on tripping.

7. Apparatus according to claim 1, wherein the control means include a proximity detector located in said first stop.

8. Apparatus according to claim 7, further including a return spring for returning the toggle lever to the cocked position, said spring exerting a smaller force on the toggle lever in the tripped position than that applied by the piston which thereby tends to hold the lever in the tripped position, a cocking control circuit for the piston for causing the piston to slide within said cylinder for a short instant, thereby compressing the associated spring and allowing the toggle lever to be cocked by the return spring.

9. Apparatus according to claim 1, wherein the monitoring means comprises means for monitoring the speed of the turbine, said monitoring means being constituted by a mass resiliently mounted to the turbine rotor and eccentric to the axis thereof for contact with the toggle lever for pushing it from its cocked position to its uncocked position when the turbine speed exceeds a predetermined value.

* * * * *